US010406406B2

(12) United States Patent
Kawabata et al.

(10) Patent No.: US 10,406,406 B2
(45) Date of Patent: Sep. 10, 2019

(54) GROMMET AND RACKET

(71) Applicant: YONEX CO., LTD., Tokyo (JP)

(72) Inventors: Masato Kawabata, Niigata (JP); Naoto Ogawa, Niigata (JP); Ryoichi Hanawa, Niigata (JP); Toru Hiraga, Tokyo (JP)

(73) Assignee: YONEX CO., LTD., Tokyo (JP)

( * ) Notice: Subject to any disclaimer, the term of this patent is extended or adjusted under 35 U.S.C. 154(b) by 0 days.

(21) Appl. No.: 16/063,607

(22) PCT Filed: Nov. 18, 2016

(86) PCT No.: PCT/JP2016/084220
§ 371 (c)(1),
(2) Date: Jun. 18, 2018

(87) PCT Pub. No.: WO2017/110327
PCT Pub. Date: Jun. 29, 2017

(65) Prior Publication Data

US 2018/0369656 A1 Dec. 27, 2018

(30) Foreign Application Priority Data

Dec. 22, 2015 (JP) ..... 2015-249505

(51) Int. Cl.
*A63B 49/00* (2015.01)
*A63B 49/14* (2015.01)
(Continued)

(52) U.S. Cl.
CPC ..... *A63B 49/022* (2015.10); *A63B 51/10* (2013.01)

(58) Field of Classification Search
CPC ..... A63B 49/022; A63B 51/00
See application file for complete search history.

(56) References Cited

U.S. PATENT DOCUMENTS 4,314,699 A * 2/1982 Bayer ..... A63B 49/02 473/544
4,591,165 A * 5/1986 Sines ..... A63B 49/14 473/540
(Continued)

FOREIGN PATENT DOCUMENTS

FR 2 851 925 9/2004
GB 2 259 256 3/1993
(Continued)

OTHER PUBLICATIONS

Official Communication issued in PCT/JP2016/084220, dated Jan. 31, 2017.

*Primary Examiner* — Raleigh W Chiu
(74) *Attorney, Agent, or Firm* — Greenblum & Bernstein, P.L.C.

(57) ABSTRACT

To enhance a resilience performance of a ball at hitting the ball, a grommet is configured to include a strip-shaped portion extending in a predetermined direction and a cylindrical portion projecting from one surface of the strip-shaped portion, the cylindrical portion being a portion through which a string passes. A bulge portion is formed on a part on another surface of the strip-shaped portion, the part being along an inner periphery of the cylindrical portion. The bulge portion has a shape bulged more than the other surface of the strip-shaped portion, and the string is folded back at the bulge portion. A plurality of the protrusions are formed between the cylindrical portions adjacent to one another, the plurality of the protrusions being portions to which the string contacts.

11 Claims, 6 Drawing Sheets

(51) Int. Cl.

| | |
|---|---|
| ***A63B 51/00*** | (2015.01) |
| ***A63B 51/10*** | (2015.01) |
| ***A63B 49/022*** | (2015.01) |

(56) References Cited

U.S. PATENT DOCUMENTS

| | | | | | |
|---|---|---|---|---|---|
| 5,054,779 | A * | 10/1991 | Marrello | A63B 49/022 | 473/522 |
| 5,257,781 | A * | 11/1993 | Sines | A63B 49/022 | 473/539 |
| 5,980,403 | A * | 11/1999 | Simidian, II | A63B 49/14 | 473/553 |
| 6,336,877 | B1 * | 1/2002 | Arroyo | A63B 51/00 | 473/539 |
| 6,440,015 | B1 * | 8/2002 | Chang | A63B 49/022 | 473/539 |
| 7,217,203 | B2 | 5/2007 | Takeuchi et al. | | |
| 8,206,248 | B2 * | 6/2012 | Iizawa | A63B 60/54 | 473/539 |
| 2010/0331126 | A1 * | 12/2010 | Iizawa | A63B 60/54 | 473/521 |
| 2013/0316858 | A1 * | 11/2013 | Yu | A63B 60/42 | 473/519 |
| 2018/0369656 | A1 * | 12/2018 | Kawabata | A63B 51/10 | |

FOREIGN PATENT DOCUMENTS

| | | |
|---|---|---|
| JP | 2002-282395 | 10/2002 |
| JP | 2002-537004 | 11/2002 |
| JP | 2005-237877 | 9/2005 |
| JP | 2010-104540 | 5/2010 |

* cited by examiner

GROMMET AND RACKET

TECHNICAL FIELD

The present invention relates to a grommet mounted to a frame of a racket to cause a string to avoid contacting the frame, and a racket.

BACKGROUND ART

A racket of tennis or badminton includes a loop-shaped frame through which a string is stretched. The frame includes a large number of insertion holes through which the string is inserted at predetermined intervals, and grommets are mounted to the insertion holes.

As the grommet, for example, as disclosed in PLT 1, a grommet is used that includes a plurality of cylindrical portions inserted into the insertion holes and a strip-shaped portion having a backside surface on which the cylindrical portions are continuous. In a state where the string is stretched through the frame, the string is passed through an inner side of the cylindrical portion to be extracted from an inner side of the frame to the outer side of the frame, and the string is folded back along a surface of the strip-shaped portion to be passed through the next cylindrical portion. That is, the string is folded back at an opening position communicated with the cylindrical portion on the surface (an outer surface) of the strip-shaped portion.

CITATION LIST

Patent Literature

PLT 1: Japanese Unexamined Patent Application Publication No. 2005-237877

SUMMARY OF INVENTION

Technical Problem

However, the grommet in PLT 1 has the strip-shaped portion between the adjacent cylindrical portions having the surface formed of a smooth surface. Then, when the folded portion of the string on the grommet is collapsed so as to be depressed by a tensile force of the string, a contact area of the string and the grommet is expanded to the inner side of the frame. There is a problem that a length of a flexure deformation of the string at hitting a ball is shortened by an amount of the expansion, thus reducing a resilience of the ball at the hitting.

The present invention has been made in consideration of the above-described circumstances and an object of the present invention is to provide a grommet and a racket configured to improve resilience performance of a ball at hitting the ball.

Solution to Problem

A grommet of the present invention includes a strip-shaped portion extending in a predetermined direction, and a cylindrical portion that projects from one surface of the strip-shaped portion, the cylindrical portion bring a portion through which a string passes. A bulge portion is formed on a part on another surface of the strip-shaped portion, the part is along an inner periphery of the cylindrical portion, the bulge portion has a shape bulged more than the other surface. The string is folded back at the bulge portion.

With this configuration, the bulge portion formed at the folded portion of the string can position the fold-back position of the string to the outer side of the frame by the height of the bulge portion. This ensures lengthening a length of the string that possibly has the flexure deformation at hitting a ball even if the bulge portion is depressed, compared with a conventional structure where the bulge portion is not formed. Consequently, an amount of deflection of the string in a ball hitting direction also increases to increase the resilience of the ball at hitting the ball, thus improving the performance in carry of the ball.

According to the grommet of the present invention, preferably, a plurality of the cylindrical portions are formed in the extending direction of the strip-shaped portion at predetermined intervals, and a protrusion is further disposed on the other surface of the strip-shaped portion and between the cylindrical portions adjacent to one another, the protrusion having a distal end to which the string contacts. With this configuration, the string can contact or bite into the distal end of the protrusion. This causes friction between the string and the protrusion to ensure restricting movement of the string positioned on the outer side of the strip-shaped portion with a force applied at hitting a ball. This restriction of the movement ensures efficiently converting the force applied by hitting a ball into repulsion force, and further, ensures increasing contact pressure of a ball hitting surface formed by the string to enhance spin performance.

According to the grommet of the present invention, preferably, a plurality of the protrusions are formed between the cylindrical portions adjacent to one another in the extending direction of the strip-shaped portion at predetermined intervals. With this configuration, the friction force between the string and the protrusion can be much increased to ensure further enhancing the resilience performance and the spin performance.

According to the grommet of the present invention, preferably, the protrusion has a shape extending in a direction intersecting with the contacting string. This configuration can support the strings having various thicknesses, and moreover, the string can easily bite into the distal end of the protrusion to contribute to improving the friction force of them.

A racket of the present invention includes the grommet and a frame to which the string is tightly stretched, the frame forming a ball hitting surface. The grommet is mounted to the frame, and the tightly stretched string is folded back at the bulge portion.

According to the racket of the present invention, preferably, the bulge portion is formed on a part where the string extending in a width direction on a central region of the frame is folded back. This configuration ensures effectively enhancing the resilience of the string on what is called a sweet spot.

Advantageous Effects of Invention

According to the present invention, the bulge portion formed at the folded portion of the string ensures enhancing the resilience performance of the ball at hitting the ball.

BRIEF DESCRIPTION OF DRAWINGS

FIG. 1A is a front view of the racket and FIG. 1B is a side view of the racket.

DESCRIPTION OF EMBODIMENTS

Figures 1A, 1B:
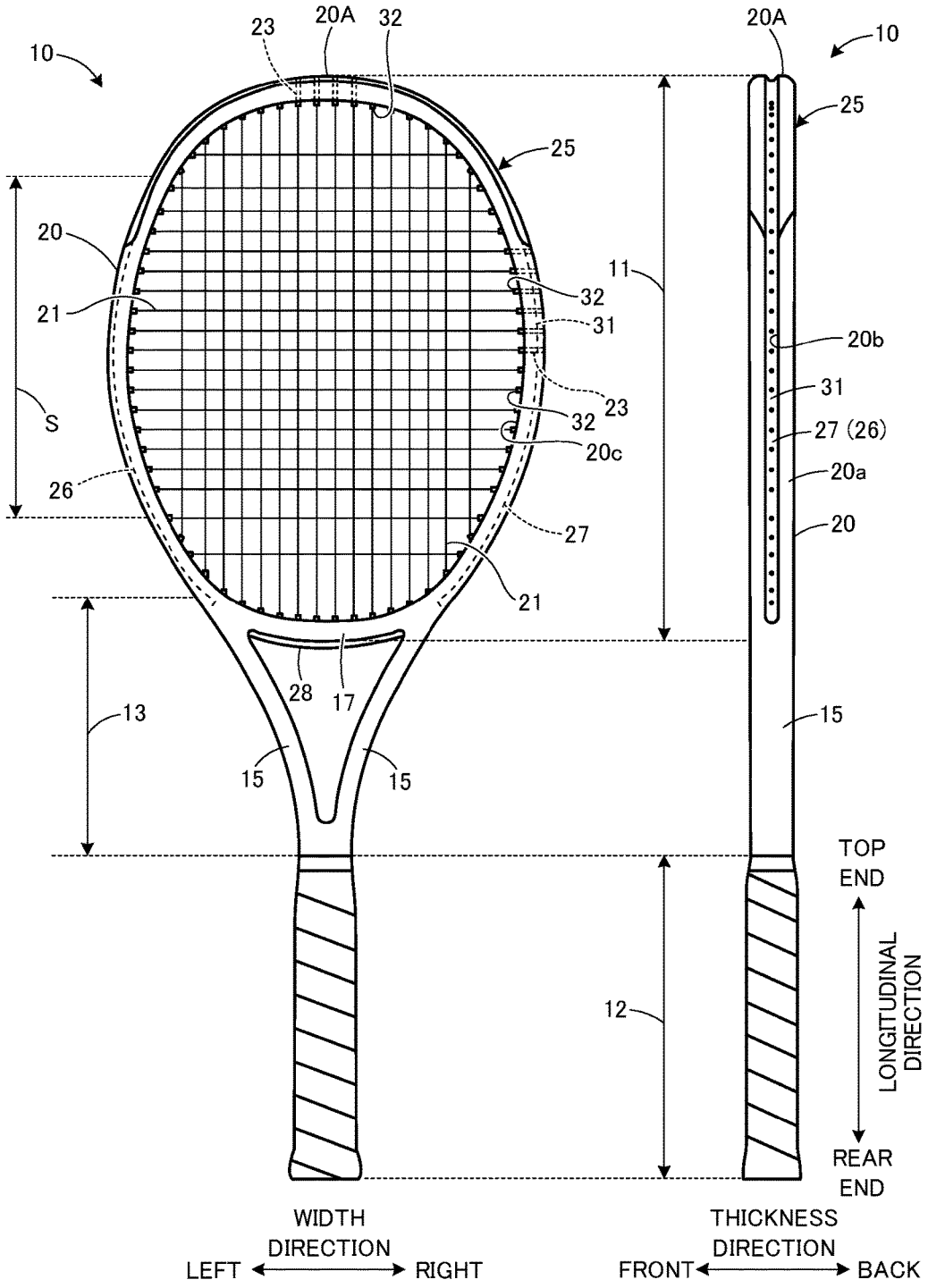
FIGS. 1A and 1B are external views of a racket according to the embodiment.

The following specifically describes embodiments of the present invention by referring to the drawings. While the following describes an example where a grommet according to the present invention is applied to a tennis racket, an application target is changeable without limiting to this. For example, the grommet may be applied to a soft tennis racket, a squash racket, a badminton racket, and similar racket.

FIG. 1 are external views of a racket according to the embodiment of the present invention, and FIG. 1A is a front view of the racket and FIG. 1B is a side view of the racket. The following drawings each omit a part of configuration for convenience of explanation.

As illustrated in FIG. 1, a racket 10 includes a head 11 as a portion for hitting a ball, a grip 12 as a portion with which a player grips the racket 10, and a shaft 13 integrally couples the head 11 to the grip 12. In the following description, as indicated by arrows in FIG. 1, a side on which the head 11 is positioned is defined as a top end side, and a side on which the grip 12 is positioned is defined as a rear end side in a longitudinal direction of the racket 10. On a ball hitting surface of the racket 10 (that is, on a surface along the ball hitting surface), a direction perpendicular to the longitudinal direction is defined as a width direction (or a right-left direction), and a direction perpendicular to the ball hitting surface of the racket 10 is defined as a thickness direction (or a front-back direction).

The shaft 13 includes a throat 15 that bifurcates from the grip 12 to the head 11 viewing in the front-back direction, and a yoke 17 is disposed between right and left sides of the throat 15 to form a part of the head 11. Not limited to this, the shaft 13 not being bifurcated may be employed.

The head 11 includes an elliptical-shaped frame 20 having a longer side in an up-down direction and a string 21 tightly stretched on an inner side of the frame 20, and has the ball hitting surface (face) on the inner side of the frame 20. The frame 20 is obtained by forming a hollow cylindrical body made of, for example, fiber-reinforced plastic in an elliptical shape. The frame 20 is not necessary hollow but may be internally filled with a foam material, or may be made of wood or metal.

The frame 20 has an outer peripheral surface 20*a* that includes a groove 20*b* having the center portion in the thickness direction depressed with respect to both sides. The groove 20*b* is continuously disposed along a circumferential direction of the frame 20. The frame 20 includes an insertion hole 23, and the insertion hole 23 is disposed to pass through the groove 20*b* of the frame 20 from a bottom side to an inner peripheral surface 20*c*. A plurality of insertion holes 23 are disposed along the circumferential direction of the frame 20.

On the frame 20, four grommets 25 to 28 are mounted from an outer peripheral side of the frame 20, and the string 21 is tightly stretched to the frame 20 via the grommets 25 to 28. In this embodiment, the grommet 25 on the top end side is disposed from a part in an approximately 10 o'clock direction to a part in an approximately 2 o'clock direction in front view of the frame 20 in FIG. 1A, and protects a top 20A side of the frame 20. The left and right grommets 26 and 27 are disposed from vicinities of both left and right ends of the grommet 25 on the top end side to positions reaching lower most insertion holes 23 formed on left and right side surfaces of the frame 20. The grommet 28 on the rear end side is disposed on the yoke 17. Lengths of the grommets 25 to 27, other than the grommet 28 on the rear end side, along the circumferential direction of the frame 20 may be changed corresponding to various conditions.

Subsequently, a specific configuration of the grommet 26 on the left side will be described. The grommet 26 includes a strip-shaped portion 31 extending in the circumferential direction of the frame 20 as a predetermined direction, and a plurality of cylindrical portions 32 projecting from a backside surface as one surface of the strip-shaped portion 31. The strip-shaped portion 31 has a front-back width configured to be smaller than a front-back width of the frame 20. A plurality of cylindrical portions 32 are disposed in the extending direction of the strip-shaped portion 31 at predetermined intervals.

Figure 2:
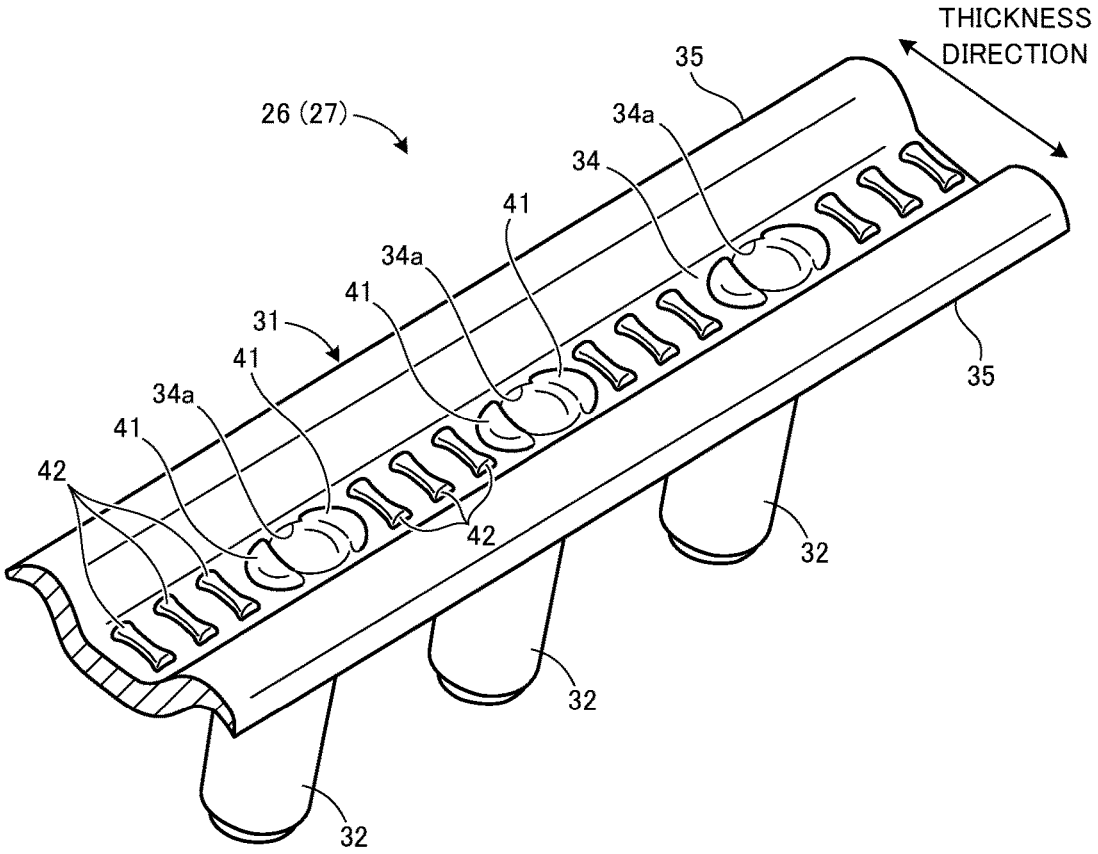
FIG. 2 is a schematic perspective view as a partially sectioned view of a grommet.
Figure 3:
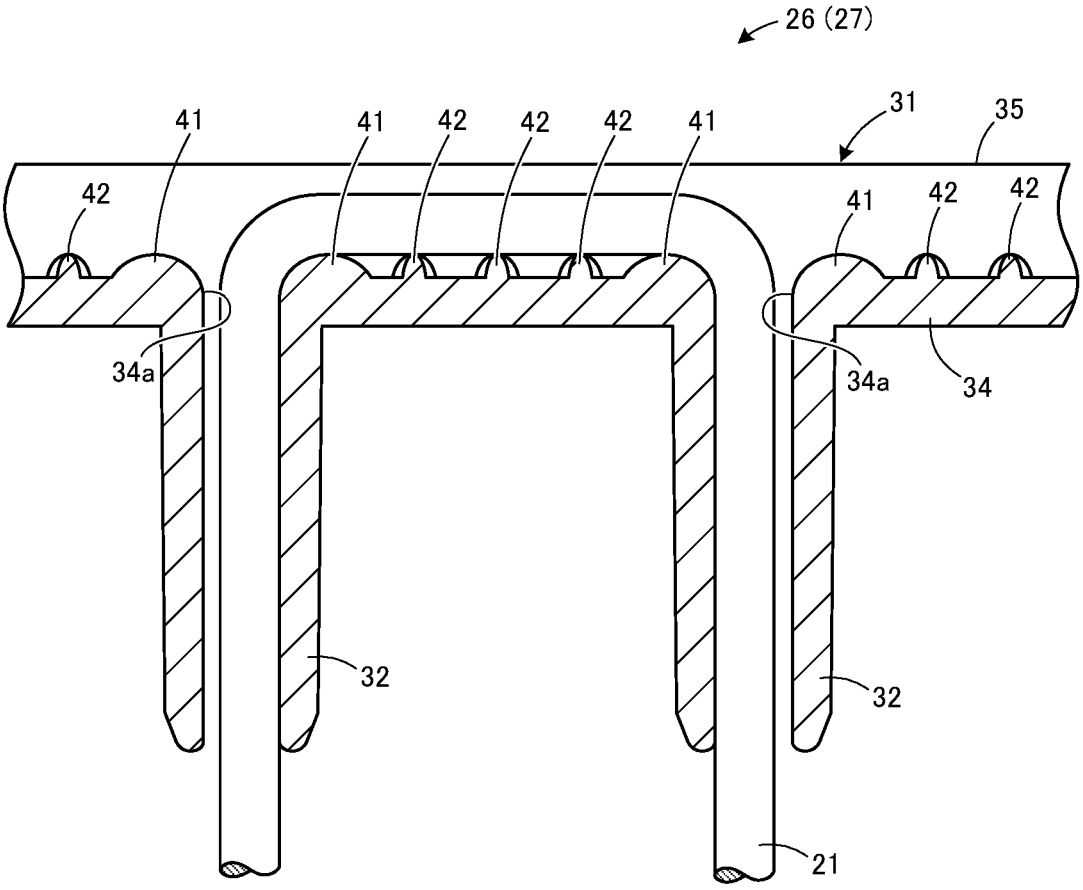
FIG. 3 is a cross-sectional view of a frame and the grommet taken in a right-left direction.

FIG. 2 is a schematic perspective view as a partially sectioned view of a grommet. FIG. 3 is a cross-sectional view of the grommet taken in a right-left direction. As illustrated in FIG. 2 and FIG. 3, the strip-shaped portion 31 includes a bottom surface portion 34 and side surface portions 35 continuous with both front and back sides of the bottom surface portion 34. The bottom surface portion 34 is arranged so as to be brought in surface contact with the bottom side of the groove 20*b* (see FIG. 1B) of the frame 20. The side surface portions 35 are each arranged so as to be brought in surface contact with a side surface of the groove 20*b* and a part of the outer peripheral surface 20*a* (see FIG. 1B) of the frame 20. The bottom surface portion 34 and the two side surface portions 35 are internally engaged with the groove 20*b*. The bottom surface portion 34 has a surface in which openings 34*a* are communicated with inner sides of the cylindrical portions 32.

The cylindrical portion 32 has a base portion on the strip-shaped portion 31 side, and a distal end portion on the opposite side of the base portion is inserted into the insertion hole 23 (see FIG. 1A) from the outer side of the frame 20. This insertion mounts the grommet 26 to the frame 20, and in this state, the distal end side of the cylindrical portion 32 is arranged so as to inwardly project from the inner peripheral surface 20*c* side of the frame 20 (see FIG. 1A).

On a surface of the bottom surface portion 34 as the other surface of the strip-shaped portion 31, bulge portions 41 and protrusions 42 are disposed. The bulge portion 41 is disposed on a part along the opening 34*a* and has a shape bulging from the surface of the bottom surface portion 34, and the bulge portion 41 has a top formed in a curved surface shape along an approximate spherical surface. A part where the bulge portion 41 is disposed around the opening 34*a* is formed so as to be thicker than the other part.

The bulge portions 41 are each continuous with the opening 34*a* on both sides in the extending direction of the strip-shaped portion 31, and in other words, a pair of bulge portions 41 are disposed for each of a plurality of cylindrical portions 32. Viewing from the surface side of the strip-shaped portion 31, the bulge portion 41 is formed in a shape where a width in the thickness direction (a direction perpendicular to a paper surface of FIG. 3) gradually decreases as the bulge portion 41 becomes far from the opening 34*a*. Therefore, the bulge portion 41 is formed to have a predetermined width from the opening 34*a* in the extending direction of the strip-shaped portion 31, and in this embodiment, the width is configured to be smaller than three times an inner diameter of the cylindrical portion 32. This causes the bulge portions 41 disposed between the adjacent cylindrical portions 32 to be largely away from one another, and between those bulge portions 41, the bottom surface portion 34 is formed to have a constant thickness excluding the parts where the protrusions 42 are formed.

Three protrusions 42 are disposed between the cylindrical portions 32 adjacent in the extending direction of the strip-shaped portion 31 at predetermined intervals in the extending direction. In other words, on both sides of the three protrusions 42, which are aligned in the extending direction of the strip-shaped portion 31, the bulge portions 41 are disposed at predetermined intervals in the identical direction. The protrusion 42 has a shape projecting from the surface of the bottom surface portion 34 like a rib. The protrusion 42 has a shape extending in a direction (the direction perpendicular to the paper surface of FIG. 3) intersecting with an extending direction of the contacting string 21 as described below. The protrusion 42 has a middle portion in the extending direction in a narrowed shape, and the protrusion 42 is formed to have a projecting shape that becomes narrower toward the top (an upper portion in FIG. 3).

When the string 21 is tightly stretched to the frame 20 as illustrated in FIG. 1, the string 21 passes through the cylindrical portion 32 of the grommet 26 from the distal end (a lower end in FIG. 3) side to the surface side of the strip-shaped portion 31, and is folded back at the bulge portion 41 disposed along the cylindrical portion 32, as illustrated in FIG. 3. This folding back causes the string 21 positioned along the surface of the strip-shaped portion 31 to be folded back at the bulge portion 41 disposed along the next cylindrical portion 32, and the string 21 exits the cylindrical portion 32 from the distal end side. That is, on the fold-back position of the string 21, the bulge portions 41 are each positioned, and in a state where a tensile force is applied to the string 21, the string 21 bites into the bulge portion 41. The string 21 bites into or contact distal ends of the protrusions 42 as well, and the protrusions 42 each cause friction resistance against displacement or deformation of the string 21 in the extending direction.

While the above describes the grommet 26 on the left side, the grommet 27 on the right side illustrated in FIG. 1 has a similar structure other than a point that the mounting position to the frame 20 is different. The grommet 25 on the top end side illustrated in FIG. 1 has a similar structure other than a point that the mounting position to the frame 20 is different and a point that the width of the strip-shaped portion 31 is different. The strip-shaped portion 31 of the grommet 25 on the top end side is formed to have the width in the front-back direction approximately identical to the frame 20 so as to have a function to protect the frame 20.

Figure 4A:
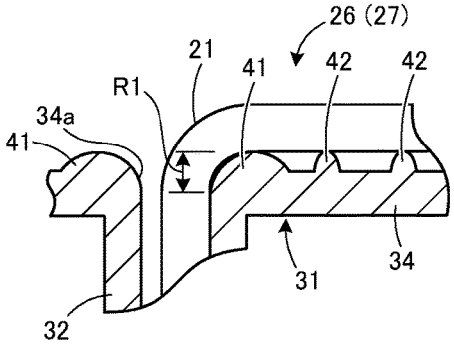
FIGS. 4A and 4B are explanatory views for a comparison of states of the string folded back by the grommet.
Figure 4B:
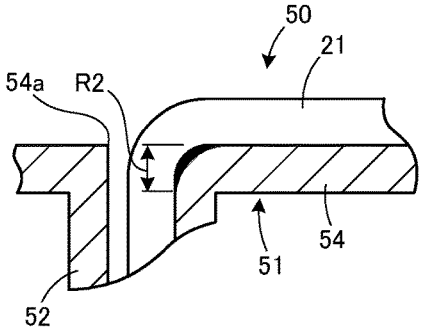

Next, a description will be given of effects of resilience performance improvement of the grommet 26 according to the embodiment. FIG. 4A is an explanatory view of the fold-back state of the string by the grommet according to the embodiment. FIG. 4B is an explanatory view of a fold-back state of a string by a grommet according to a comparative structure.

As indicated by a black part in FIG. 4A, the grommet 26 according to the embodiment collapses around the bulge portion 41 due to the biting string 21. Specifically, the string 21 bites into the grommet 26 to collapse in a range R1 from the top of the bulge portion 41 to a proximity of the opening 34*a*.

A grommet 50 according to the comparative structure in FIG. 4B has a configuration common to the grommet 26 according to the embodiment excluding that the bulge portion and the protrusion are not formed. That is, the grommet 50 according to the comparative structure has a bottom surface portion 54 having a uniform thickness even around an opening 54*a* of a strip-shaped portion 51, thus forming a surface of the bottom surface portion 54 with a smooth surface.

As indicated by a black part in FIG. 4B, the grommet 50 according to the comparative structure collapses around the opening 54*a* due to the biting string 21. Specifically, the string 21 bites in a range R2 from a surface of the bottom surface portion 54 to a distal end side (a lower side in FIG. 4B) of a cylindrical portion 52.

Generally, a force applied at hitting a ball causes a flexure deformation on the string 21, and a force to recover the flexure deformation influences the resilience performance as a performance in carry of the ball. As illustrated in FIG. 1, in a case of a weft, the length of the string 21 with the flexure deformation is a length for tightly stretching between the mutually opposing grommets 26 and 27 on the frame 20. More specifically, since the above-described biting hardly causes the flexure deformation, the length of the string 21 with the flexure deformation is a length connecting the parts into which the string 21 bites on the left and right grommets 26 and 27. This length is hereinafter referred to as "an effective length." On the string 21, increasing the effective length increases the amount of the flexure deformation, thus improving the resilience performance due to what is called a trampoline effect.

Figure 5A:
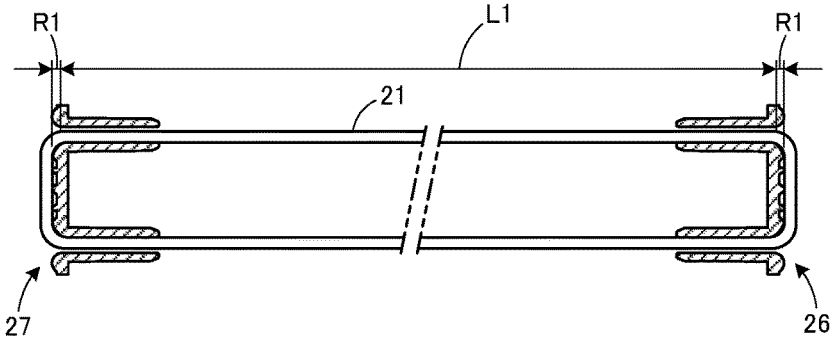
FIGS. 5A and 5B are schematic diagrams for describing by comparison of effective lengths of the string on the grommet.
Figure 5B:
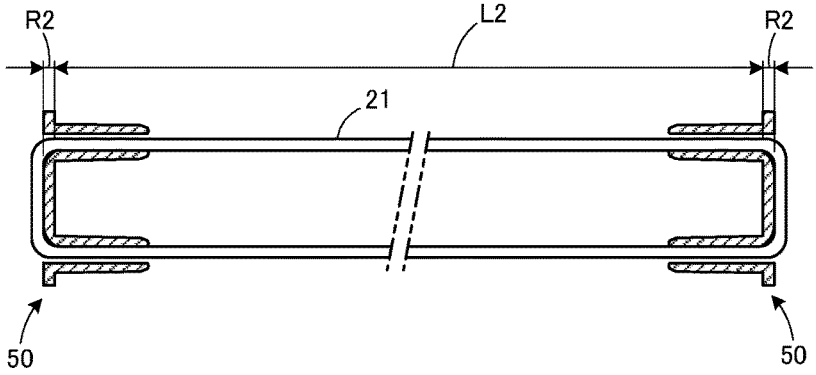

FIG. 5A is a schematic diagram describing the effective length of the string on the grommet according to the embodiment, and FIG. 5B is a schematic diagram describing the effective length of the string on the grommet according to the comparative structure. In comparison of the effective length of the string 21 between the embodiment and the comparative structure, as illustrated in FIG. 5A, an effective length L1 of the string 21 according to the embodiment is a length connecting innermost ends of the ranges R1, into which the string 21 bites, of the respective grommets 26, 27. Similarly, as illustrated in FIG. 5B, an effective length L2 of the string 21 according to the comparative structure is a length connecting innermost ends of the ranges R2, into which the string 21 bites, of the respective grommets 50, 50.

In comparison between FIG. 4A and FIG. 4B, it is apparent by the illustrations that the innermost ends (lower ends in those drawings) of the ranges R1, R2 are positioned on the outer side (the upper side in those drawings) in this embodiment compared with the comparative structure. That is, in this embodiment, forming the bulge portion 41 ensures positioning the range R1 into which the string 21 bites to the outer side. Consequently, as illustrated in FIG. 5A and FIG. 5B, the effective length L1 of this embodiment is longer than the effective length L2 of the comparative structure. Specifically, assuming the effective length L2 of the comparative structure as 100%, the effective length L1 of this embodiment is 102.7%. Thus, the lengthened effective length L1 ensures the improved resilience performance of the ball by the grommets 26, 27.

Figure 6A:
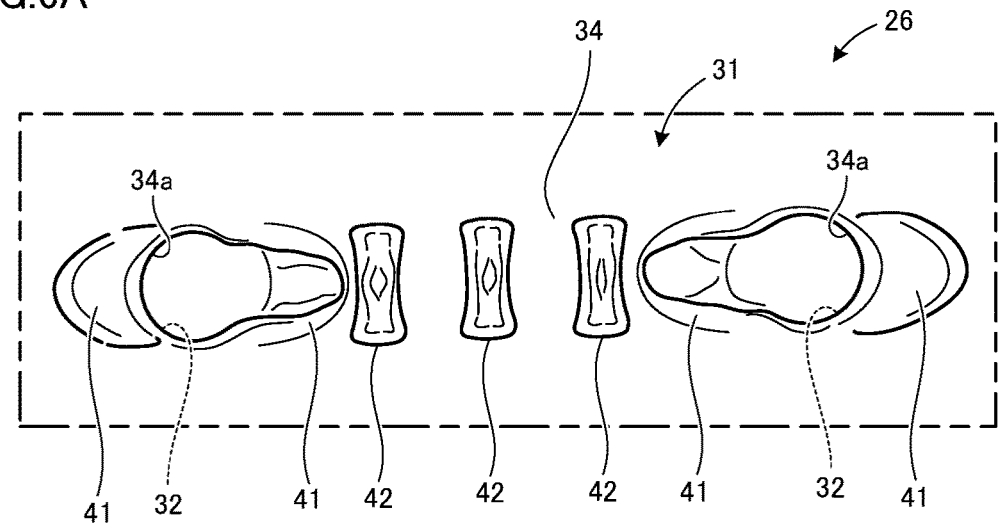
FIGS. 6A and 6B are explanatory views for a comparison of collapsed states of the grommet.
Figure 6B:
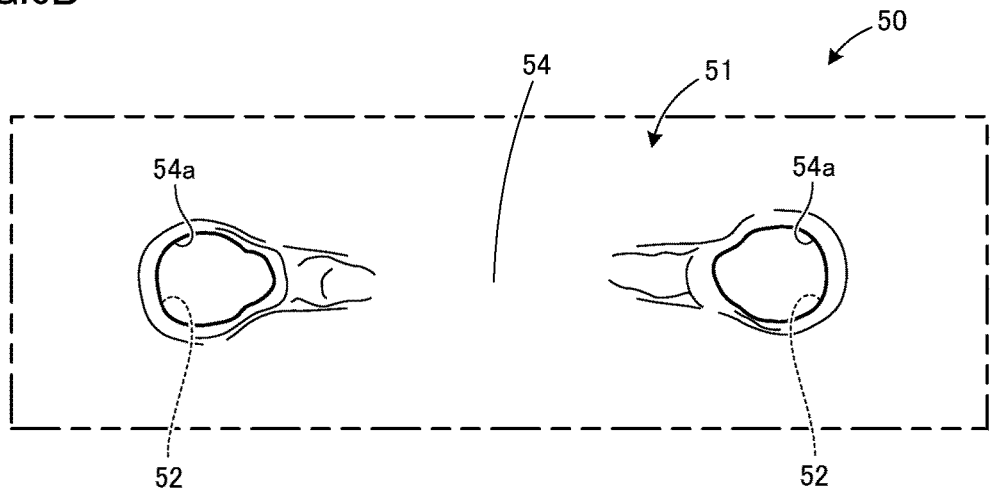

FIG. 6A is an explanatory view of a collapsed state of the grommet according to the embodiment, and FIG. 6B is an explanatory view of a collapsed state of the grommet according to the comparative structure. FIG. 6A and FIG. 6B illustrate states viewed in directions perpendicular to the surfaces of the strip-shaped portions 31, 51, and illustrate states where polyester strings are tightly stretched with tensile force of 60 lbs and subsequently removed, based on photographs. As illustrated in FIG. 6A, in the embodiment, between the cylindrical portions 32 adjacent to one another in the extending direction of the strip-shaped portion 31, collapse occurs at two bulge portions 41 as the fold-back positions of the string. Furthermore, collapse occurs at middle portions in the extending directions (the up-down direction in the drawing) of three protrusions 42. Accordingly, it is understood that, in the embodiment, the tightly stretched string bites into not only the two bulge portions 41 but also each of the three protrusions 42.

As illustrated in FIG. 6B, in the comparative structure, between the cylindrical portions 52 adjacent to one another, collapse occurs in a region including the opening 54*a*. While this collapse extends toward the middle of the adjacent cylindrical portions 52, the collapse does not occur at this middle. Accordingly, it is understood that, in the comparative structure, the tightly stretched string has an arch shape between the cylindrical portions 52 such that the middle portion is apart from or slightly contacts the strip-shaped portion 51.

As described above, in the embodiment, the two bulge portions 41 and the three protrusions 42 are brought into close contact with the string to increase portions to be brought into close contact with the string compared with the comparative structure. Therefore, the friction resistance with the string on the surface side of the strip-shaped portion 31 can be much increased in the embodiment. Then, even if the string is pulled to the inner side of the frame 20 (see FIG. 1) by the force applied at hitting a ball, the movement of the string between the two bulge portions 41 (the openings 34*a*) can be restricted. Since the elimination of energy loss by the restricted amount ensures the repulsion force efficiently converted from the force applied by hitting the ball, thus increasing the resilience of the ball at hitting the ball to ensure the improved performance in carry of the ball. Moreover, since contact pressure on the ball hitting surface formed by the string is increased, stronger tensile force can be maintained to give spin on the ball so as to squash the ball, thus improving spin performance.

When a maximum collapse amount at the bulge portion 41 in the embodiment and a maximum collapse amount around the opening 54*a* in the comparative structure are measured to be compared, the maximum collapse amount in the comparative structure was about 127 assuming the maximum collapse amount in the embodiment to 100. Accordingly, in the embodiment, load applied to the grommet from the string can be reduced by about 27% compared with the comparative structure.

Next, a description will be given of an experiment performed for evaluating the trajectories in cases of the grommets according to the embodiment. In the experiment, rackets including the grommets of Working Examples 1 to 3 and a racket including the grommet of the above-described comparative structure were prepared. The rackets were in an identical condition except changing the grommet. The grommet of Working Example 1 was configured to have the structure of the above-described embodiment. The grommet of Working Example 2 was configured such that the bulge portion was formed similarly to the above-described embodiment, and the protrusion was scraped off to form the region where the protrusion was formed into a surface smooth to the surface of the bottom surface portion. The grommet of Working Example 3 was configured such that the protrusion was formed similarly to the above-described embodiment, and the bulge portion was scraped off to form the region where the bulge portion was formed into a surface smooth to the surface of the bottom surface portion. The grommet of the comparative structure was configured to have the structure described in FIG. 4B, and have the configuration where the bulge portion and the protrusion were scraped off relative to the above-described embodiment.

Figure 7:
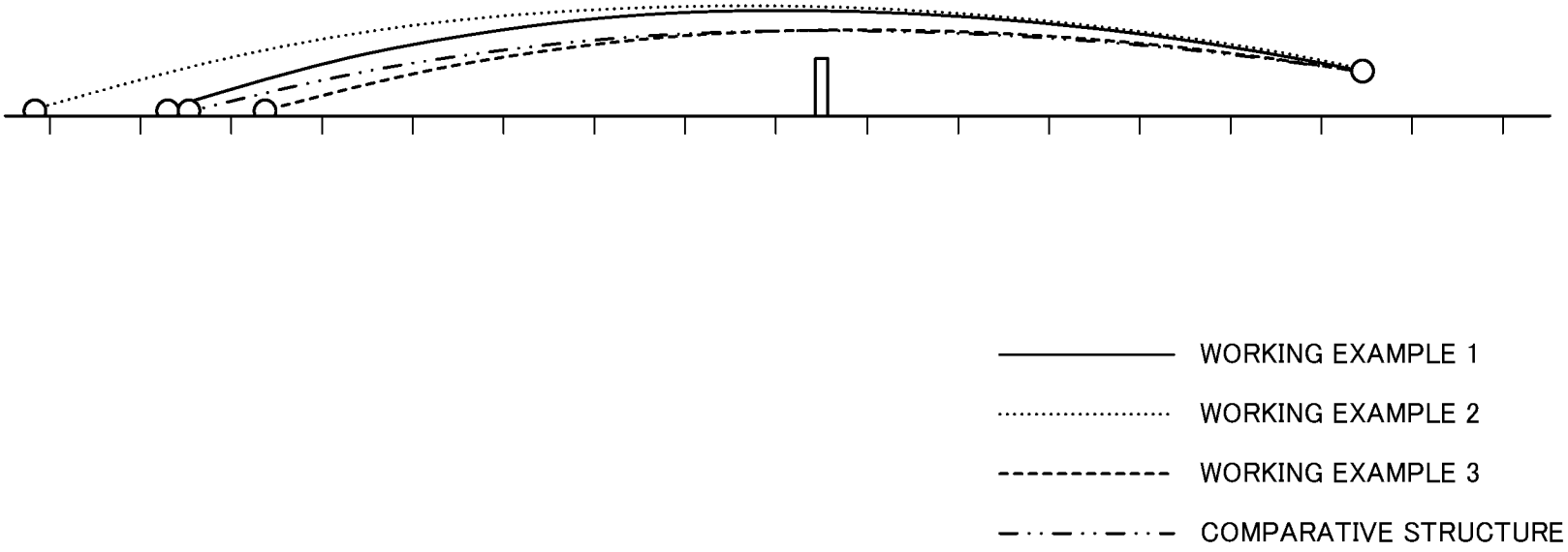
FIG. 7 is a drawing illustrating trajectory measurement results of Working Examples 1 to 3 and a comparative structure.

With the rackets of Working Examples 1 to 3 and the comparative structure, a plurality of testers hit the ball multiple times in strokes on a tennis coat. A tennis version TrackMan (ball trajectory measuring instrument) was used to measure ball speeds, spin amounts, and trajectories of the hit balls to calculate average values. Table 1 below indicates relative values of the ball speeds and the spin amounts of Working Examples 1 to 3 assuming the measurement values of the comparative structure to 100. FIG. 7 illustrates trajectory measurement results of Working Examples 1 to 3 and the comparative structure.

TABLE 1

| | BALL SPEED | SPIN AMOUNT |
|---|---|---|
| WORKING EXAMPLE 1 | 108 | 104 |
| WORKING EXAMPLE 2 | 110 | 97 |
| WORKING EXAMPLE 3 | 106 | 106 |

In Working Example 1, as illustrated in FIG. 7, the trajectory was high and a carrying distance was slightly extended compared with the comparative structure. As indicated in Table 1, both ball speed and spin amount were improved compared with the comparative structure. Then, the grommet of Working Example 1 including the bulge portion and the protrusion lengthened the effective length of the string to enhance the resilience performance, and simultaneously increased the friction force between the string and the surface of the grommet to increase the contact pressure, thus ensuring enhancing the spin performance. Accordingly, compared with the comparative structure, the trajectory where the ball was passed through a high position above the net by hitting the ball while the carrying distance was similar was obtained.

In Working Example 2, as illustrated in FIG. 7, the trajectory was high and the carrying distance was long compared with the comparative structure. As indicated in Table 1, the ball speed was improved while the spin amount slightly decreased compared with the comparative structure. Then, the grommet of Working Example 2 including the bulge portion lengthened the effective length of the string to enhance the resilience performance. Accordingly, compared with the comparative structure, the trajectory where the ball was passed through a high position above the net by hitting the ball while the carrying distance was longer was obtained.

In Working Example 3, as illustrated in FIG. 7, the trajectory had a similar height and a shorter carrying distance compared with the comparative structure. As indicated in Table 1, both ball speed and spin amount were improved compared with the comparative structure. Then, the grommet of Working Example 3 including the protrusion increased the friction force between the string and the surface of the grommet to increase the contact pressure, thus ensuring enhancing the spin performance. Accordingly, compared with the comparative structure, this obtained the trajectory where the ball was passed through a similar height position above the net by hitting the ball while the carrying distance became short.

The present invention is not limited to the above-described embodiment, and various modifications can be made to embody. In the above-described embodiment, the size, the shape, the direction, and similar factor illustrated in the attached drawings are not limited to those, and may be appropriately changed in a range that can provide the effects of the present invention. Moreover, the present invention may be appropriately changed to embody without departing from a scope of the object of the present invention.

For example, the bulge portion 41 and the protrusion 42 may be disposed on the whole regions in the extending directions of the grommets 25 to 28, or may be disposed on a part of the region. For example, as illustrated in FIG. 1, on the grommets 25 to 27, the bulge portion 41 and the protrusion 42 may be formed only on a part where the string 21 extending in the width direction at a sweet spot as the central region of the frame 20, that is, the string 21 as a weft within a region S is folded back. In this case, in a part that influences on especially the performance in carry of the ball and the spin amount, those performances of the string 21 can be effectively improved. The sweet spot is a region where an impact transmitted to a hand that grips the grip 12 at hitting the ball becomes minimum.

A count of the protrusions 42 formed between the adjacent cylindrical portions 32 may be one or plural such as two, or four or more.

As long as the above-described performances are obtained, forming the protrusion 42 may be omitted as in Working Example 2, or forming the bulge portion 41 may be omitted as in Working Example 3.

The shape of the protrusion 42 may be variously changed as long as the protrusion 42 can contact the string 21, and may be changed to a protruding shape where the planar shape is a circular shape of a square shape instead of the rib shape, or a shape having a distal end in a pillar shape.

The bulge portion 41 also may be changed to have the other shape as long as the performance similar to that of the above-described embodiment is provided.

The shapes of the strip-shaped portion 31 and the cylindrical portion 32 of the grommets 26, 27 are not limited to the illustrated exemplary configurations, and may be changed corresponding to the shape of the frame 20 and similar shape.

INDUSTRIAL APPLICABILITY

The present invention is a grommet mounted to a frame of a racket and a racket to which the grommet is mounted, and provides an effect of enhancing resilience performance of a ball at hitting the ball.

This application is based on Japanese Patent Application No. 2015-249505 filed on Dec. 22, 2015, and the disclosure of which is incorporated herein.

The invention claimed is:

1. A grommet comprising:

a strip-shaped portion extending in a predetermined direction; and a plurality of cylindrical portions provided at predetermined intervals with respect to an extending direction of the strip-shaped portion, each cylindrical portion projecting from one surface of the strip-shaped portion, a string passing through each of the cylindrical portions, wherein a bulge portion is formed, on a part on another surface of the strip-shaped portion, alongside an inner perimeter of each of the cylindrical portions, wherein each of the bulge portions has a shape bulging from the other surface, the string is folded back at each of the bulge portions, and an apex of each of the bulge portions has a curved profile following a spherical surface, and wherein a plurality of protrusions are further provided on the other surface of the strip-shaped portion between mutually adjacent cylindrical portions at predetermined intervals with respect to an extending direction of the strip-shaped portion, the string coming into contact with ends of the protrusions.

2. The grommet according to claim 1, wherein the strip-shaped portion is provided with openings formed through the cylindrical portions, respectively, wherein the bulge portions are communicably connected with the openings, respectively, at each side of each opening, with respect to the extending direction of the strip-shaped portion, and wherein, when viewed from the other surface of the strip-shaped portion, each of the bulge portions has a width, in a direction orthogonal to the extending direction the strip-shaped portion, that gradually decreases with respect to a direction away from an associated one of the openings.

3. The grommet according to claim 2, wherein each of the protrusions has a shape extending in a direction intersecting with the contacting string, the extending direction of each of the protrusions being orthogonal to the extending direction of the strip-shaped portion.

4. The grommet according to claim 3, wherein each protrusion has a sectional shape, in a plane defined by a protruding direction of the protrusion and a direction orthogonal to the extending direction of the protrusion, that becomes increasingly narrower toward a top end of the protrusion, respectively.

5. The grommet according to claim 3, wherein a middle portion, with respect to the extending direction of each of the protrusions, is narrower than the remaining portions thereof.

6. The grommet according to claim 1, wherein each of the protrusions has a shape extending in a direction intersecting with the contacting string, the extending direction of each of the protrusions being orthogonal to the extending direction of the strip-shaped portion.

7. The grommet according to claim 6, wherein each protrusion has a sectional shape, in a plane defined by a protruding direction of the protrusion and a direction orthogonal to the extending direction of the protrusion, that becomes increasingly narrower toward a top end of the protrusion, respectively.

8. The grommet according to claim 6, wherein a middle portion, with respect to the extending direction of each of the protrusions, is narrower than the remaining portions thereof.

9. A racket comprising:

the grommet according to claim 1; and a frame to which the string is tightly tensioned, wherein the grommet is mounted to the frame, and the tightly tensioned string is folded back at the bulge portions.

10. The racket according to claim 9, wherein the bulge portion is formed on a part where the string extending in a width direction on a central region of the frame is folded back.

11. The racket according to claim 9, wherein the string is tightly tensioned so that the string bites into the bulge portions.

* * * * *